US009438359B2

(12) United States Patent
Haslam

(10) Patent No.: US 9,438,359 B2
(45) Date of Patent: Sep. 6, 2016

(54) AUDIO BROADCAST SOURCES SWITCHING BY GEOGRAPHIC LOCATION

(71) Applicant: Microsoft Technology Licensing, LLC, Redmond, WA (US)

(72) Inventor: Andrew David Mark Haslam, Sammamish, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 217 days.

(21) Appl. No.: 14/073,810

(22) Filed: Nov. 6, 2013

(65) Prior Publication Data

US 2015/0124971 A1 May 7, 2015

(51) Int. Cl.

| | |
|---|---|
| ***H04H 5/00*** | (2006.01) |
| ***H04H 20/47*** | (2008.01) |
| ***H04H 20/20*** | (2008.01) |

(Continued)

(52) U.S. Cl.

CPC ..... *H04H 20/47* (2013.01); *H04H 20/20* (2013.01); *H04H 20/26* (2013.01); *H04H 60/51* (2013.01)

(58) Field of Classification Search

CPC .. H04R 2499/15; H04R 29/003; H04R 5/04; G10H 1/361; G10H 2210/091; G10L 21/00; G11B 19/02; G11B 2005/0018; G11B 23/0007; G11B 5/00; G11B 5/39; H04S 3/02

USPC ..... 381/1–3, 123, 56–58; 455/418, 419, 455/550.1, 3.06; 348/192, 180; 700/94

See application file for complete search history.

(56) References Cited

U.S. PATENT DOCUMENTS

| | | | |
|---|---|---|---|
| 7,596,194 | B2 | 9/2009 | Janky |
| 8,249,497 | B2 | 8/2012 | Ingrassia et al. |

(Continued)

FOREIGN PATENT DOCUMENTS

| | | | |
|---|---|---|---|
| DE | 102005041653 | A1 | 3/2007 |
| EP | 863632 | A2 | 9/1998 |

(Continued)

OTHER PUBLICATIONS

"International Search Report and Written opinion Issued in PCT Patent Application No. PCT/US2014/063782", Mailed Date: Jan. 20, 2015, 10 pages.

(Continued)

*Primary Examiner* — Lun-See Lao

(74) *Attorney, Agent, or Firm* — John Jardine; Harri Valio; Micky Minhas

(57) ABSTRACT

The automated switching of broadcast sources of an audio content stream based on the geographic location of the physical unit that is receiving the audio content stream. For instance, while rendering a particular audio content stream from a first broadcasting source, a system may have an identity of one or more alternative possible broadcasting sources available for the same audio content stream for that relative geographic location. In response to some decision making, the system may decide to switch broadest sources for that audio content stream. Thus, the user continues to listen to the audio content stream without being subject to possible negative consequences of continuing to listen to the audio content stream as received from the original broadcast station. Data transmitted by the broadcast stations themselves need not be relied upon. Thus, the automated switching is accomplished even outside of regions in which broadcast stations transmit such data.

20 Claims, 4 Drawing Sheets

(51) Int. Cl.
*H04H 20/26* (2008.01)
*H04H 60/51* (2008.01)

(56) References Cited

U.S. PATENT DOCUMENTS

| | | | | |
|---|---|---|---|---|
| 8,620,293 | B2 * | 12/2013 | Krinsky | H04H 20/26 455/403 |
| 2003/0040272 | A1 * | 2/2003 | Lelievre | H04H 20/26 455/3.06 |
| 2005/0153650 | A1 | 7/2005 | Hikomoto | |
| 2006/0195239 | A1 * | 8/2006 | Teichner | H04H 20/26 701/36 |
| 2008/0248743 | A1 | 10/2008 | Krinsky | |
| 2010/0010648 | A1 | 1/2010 | Bull et al. | |
| 2012/0316663 | A1 * | 12/2012 | Sasanabe | H04H 40/18 700/94 |
| 2012/0322434 | A1 | 12/2012 | Samuel et al. | |

FOREIGN PATENT DOCUMENTS

| | | | |
|---|---|---|---|
| EP | 1659711 | A1 | 5/2006 |
| EP | 2066051 | A1 | 6/2009 |

OTHER PUBLICATIONS http://groups.yahoo.com/neo/groups/empeg/conversations/topics/302 (2 Pages), Sep. 29, 1999.

"Second Written Opinion Issued in PCT Application No. PCT/US2014/063782", Mailed Date: Oct. 5, 2015, 5 pages.

"International Preliminary Report on Patentability Issued in PCT Application No. PCT/US2014/063782", Mailed Date: Feb. 9, 2016, 7 pages.

* cited by examiner

AUDIO BROADCAST SOURCES SWITCHING BY GEOGRAPHIC LOCATION

BACKGROUND

Audio content streams are commonly provided by broadcast sources. For instance, Amplitude Modulated (AM) and Frequency Modulated (FM) radio stations have been in existence for this and most of the previous century. More recently, other types of audio broadcast sources have become available such as satellite radio, Internet radio, and digital radio. Some of these broadcast sources are limited to a particular geographical range as the broadcast signal tends to diminish in strength with distance from the broadcast transmitter.

It is common that within a given geographical region, there may be multiple broadcast sources available for a given audio content stream. For instance, consider an audio feed from a live sporting event. Often, one can obtain the same audio feed from both an AM radio station and an FM radio station. If the quality of the received audio signal from the current station diminishes, then the user might search for other stations, if any, that provide the same audio content stream.

There are regions in the world in which radio stations not only broadcast an audio content stream, but also broadcast associated metadata that definitively identifies the audio content stream. For instance, many European radio stations employ a Radio Data Systems (or RDS) protocol in which some digital information is embedded within conventional FM radio broadcasts. However, much of the world still does not use such broadcast protocols. Furthermore, the digital information identifying the audio content is not continuously transmitted at every instant for every radio station, and thus using that information to always know alternative sources is much more than a trivial problem even in that setting.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY

At least some embodiments described herein refer to the automated switching of broadcast sources of an audio content stream based on the geographic location of the physical unit that is receiving the audio content stream. For instance, while rendering a particular audio content stream from a first broadcasting source, a system may have an identity of one or more alternative possible broadcasting sources available for the same audio content stream for that relative geographic location. In response to some decision making, the system may decide to switch broadcast sources for that audio content stream.

Thus, the user continues to listen to the audio content stream without being subject to possible negative consequences of continuing to listen to the audio content stream as received from the original broadcast station. Furthermore, since geographic location is used to determine available broadcast sources for the same audio content stream, data transmitted by the broadcast stations themselves need not be relied upon. Thus, the automated switching is accomplished even outside of regions in which broadcast stations transmit such geographic data.

This summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION

Figure 1:
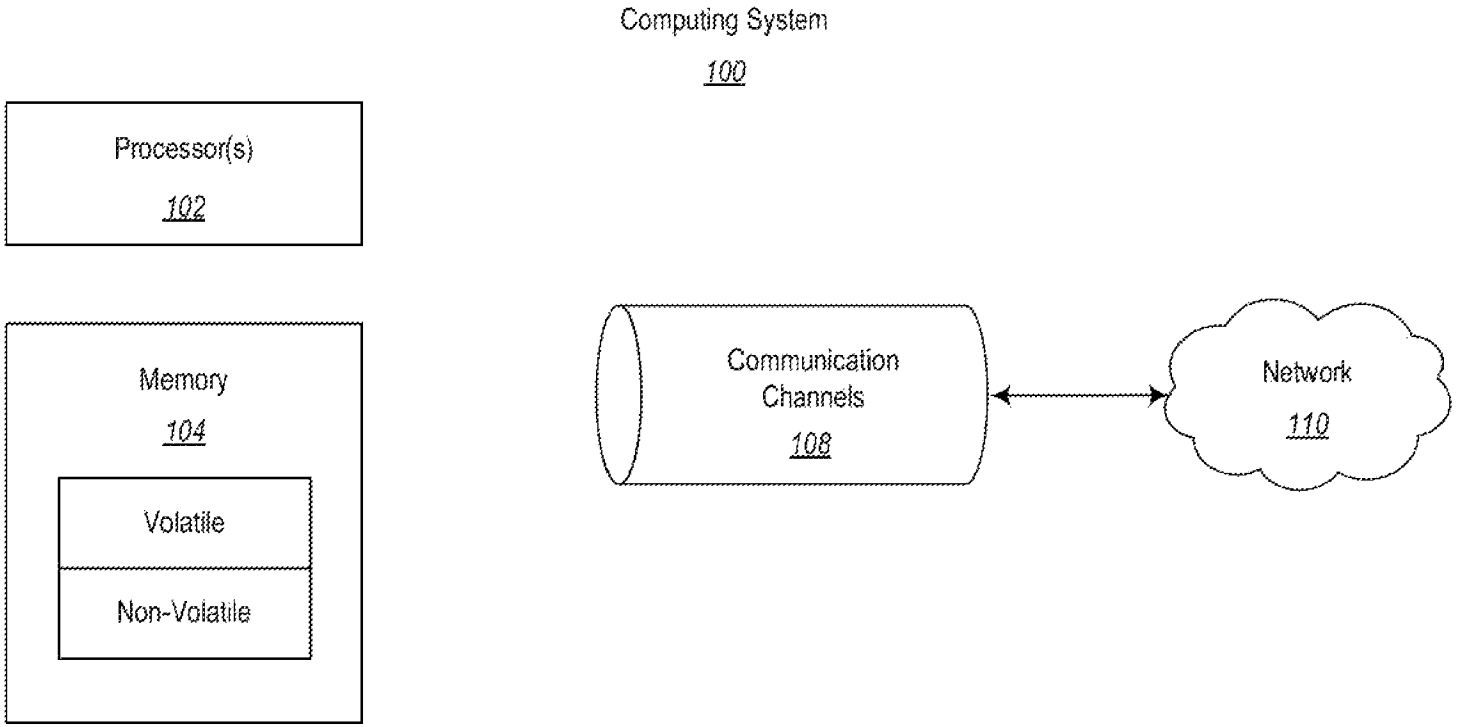
FIG. 1 illustrates an example computing system in which the principles described herein may be employed.

At least some embodiments described herein include the automated switching of broadcast sources of an audio content stream based on the geographic location of the receiver of the physical unit that is receiving the audio content stream. For instance, while rendering a particular audio content stream from a first broadcasting source, a system may have an identity of one or more alternative possible broadcasting sources available for the same audio content stream for that relative geographic location. In response to some decision making, the system may decide to switch broadcast sources for that audio content stream.

For instance, while listening to an audio feed from a particular live sporting event on a particular Amplitude Modulated (AM) radio station, the system may determine that there is another AM radio station available, and another FM station that are broadcasting the same audio feed. This determination is independent of any metadata describing the audio feed transmitted by the radio stations itself, and thus the determination may be made outside of regions in which such metadata is transmitted. Thus, the user continues to enjoy the audio feed from the particular sporting event uninterrupted by potential negative side effects of staying with the same AM radio station, and without having to manually find another replacement station once the negative side effects came into play.

Thus, the user continues to listen to the audio content stream without being subject to possible negative consequences of continuing to listen to the audio content stream as received from the original broadcast station. Furthermore, since geographic location is used to determine available broadcast sources for the same audio content stream, data transmitted by the broadcast stations themselves need not be relied upon. Thus, the automated switching is accomplished even outside of regions in which broadcast stations transmit such data.

Although the subject matter has been described in language specific to structural features and/or methodological acts, it is to be understood that the subject matter defined in the appended claims is not necessarily limited to the described features or acts described above, or the order of the acts described above. Rather, the described features and acts are disclosed as example forms of implementing the claims.

Computing systems are now increasingly taking a wide variety of forms. Computing systems may, for example, be handheld devices, appliances, laptop computers, desktop computers, mainframes, distributed computing systems, or even devices that have not conventionally been considered a computing system. In this description and in the claims, the term "computing system" is defined broadly as including any device or system (or combination thereof) that includes at least one physical and tangible processor, and a physical and tangible memory capable of having thereon computer-executable instructions that may be executed by the processor. A computing system may be distributed over a network environment and may include multiple constituent computing systems.

As illustrated in FIG. 1, in its most basic configuration, a computing system 100 typically includes at least one processing unit 102 and memory 104. The memory 104 may be physical system memory, which may be volatile, non-volatile, or some combination of the two. The term "memory" may also be used herein to refer to non-volatile mass storage such as physical storage media. If the computing system is distributed, the processing, memory and/or storage capability may be distributed as well.

As used herein, the term "executable module" or "executable component" can refer to software objects, routings, or methods that may be executed on the computing system. The different components, modules, engines, and services described herein may be implemented as objects or processes that execute on the computing system (e.g., as separate threads).

In the description that follows, embodiments are described with reference to acts that are performed by one or more computing systems. If such acts are implemented in software, one or more processors of the associated computing system that performs the act direct the operation of the computing system in response to having executed computer-executable instructions. For example, such computer-executable instructions may be embodied on one or more computer-readable media that form a computer program product. An example of such an operation involves the manipulation of data. The computer-executable instructions (and the manipulated data) may be stored in the memory 104 of the computing system 100. Computing system 100 may also contain communication channels 108 that allow the computing system 100 to communicate with other message processors over, for example, network 110.

Embodiments described herein may comprise or utilize a special-purpose or general-purpose computer system that includes computer hardware, such as, for example, one or more processors and system memory, as discussed in greater detail below. The system memory may be included within the overall memory 104. The system memory may also be referred to as "main memory", and includes memory locations that are addressable by the at least one processing unit 102 over a memory bus in which case the address location is asserted on the memory bus itself. System memory has been traditional volatile, but the principles described herein also apply in circumstances in which the system memory is partially, or even fully, non-volatile.

Embodiments within the scope of the present invention also include physical and other computer-readable media for carrying or storing computer-executable instructions and/or data structures. Such computer-readable media can be any available media that can be accessed by a general-purpose or special-purpose computer system. Computer-readable media that store computer-executable instructions and/or data structures are computer storage media. Computer-readable media that carry computer-executable instructions and/or data structures are transmission media. Thus, by way of example, and not limitation, embodiments of the invention can comprise at least two distinctly different kinds of computer-readable media: computer storage media and transmission media.

Computer storage media are physical hardware storage media that store computer-executable instructions and/or data structures. Physical hardware storage media include computer hardware, such as RAM, ROM, EEPROM, solid state drives ("SSDs"), flash memory, phase-change memory ("PCM"), optical disk storage, magnetic disk storage or other magnetic storage devices, or any other hardware storage device(s) which can be used to store program code in the form of computer-executable instructions or data structures, which can be accessed and executed by a general-purpose or special-purpose computer system to implement the disclosed functionality of the invention.

Transmission media can include a network and/or data links which can be used to carry program code in the form of computer-executable instructions or data structures, and which can be accessed by a general-purpose or special-purpose computer system. A "network" is defined as one or more data links that enable the transport of electronic data between computer systems and/or modules and/or other electronic devices. When information is transferred or provided over a network or another communications connection (either hardwired, wireless, or a combination of hardwired or wireless) to a computer system, the computer system may view the connection as transmission media. Combinations of the above should also be included within the scope of computer-readable media.

Further, upon reaching various computer system components, program code in the form of computer-executable instructions or data structures can be transferred automatically from transmission media to computer storage media (or vice versa). For example, computer-executable instructions or data structures received over a network or data link can be buffered in RAM within a network interface module (e.g., a "NIC"), and then eventually transferred to computer system RAM and/or to less volatile computer storage media at a computer system. Thus, it should be understood that computer storage media can be included in computer system components that also (or even primarily) utilize transmission media.

Computer-executable instructions comprise, for example, instructions and data which, when executed at one or more processors, cause a general-purpose computer system, special-purpose computer system, or special-purpose processing device to perform a certain function or group of functions. Computer-executable instructions may be, for example, binaries, intermediate format instructions such as assembly language, or even source code.

Those skilled in the art will appreciate that the principles described herein may be practiced in network computing environments with many types of computer system configurations, including, personal computers, desktop computers, laptop computers, message processors, hand-held devices, multi-processor systems, microprocessor-based or programmable consumer electronics, network PCs, minicomputers, mainframe computers, mobile telephones, PDAs, tablets, pagers, routers, switches, and the like. The invention may also be practiced in distributed system environments where local and remote computer systems, which are linked (either by hardwired data links, wireless data links, or by a combination of hardwired and wireless data links) through a network, both perform tasks. As such, in a distributed system environment, a computer system may include a plurality of constituent computer systems. In a distributed system environment, program modules may be located in both local and remote memory storage devices.

Those skilled in the art will also appreciate that the invention may be practiced in a cloud computing environment. Cloud computing environments may be distributed, although this is not required. When distributed, cloud computing environments may be distributed internationally within an organization and/or have components possessed across multiple organizations. In this description and the following claims, "cloud computing" is defined as a model for enabling on-demand network access to a shared pool of configurable computing resources (e.g., networks, servers, storage, applications, and services). The definition of "cloud computing" is not limited to any of the other numerous advantages that can be obtained from such a model when properly deployed.

Figure 2:
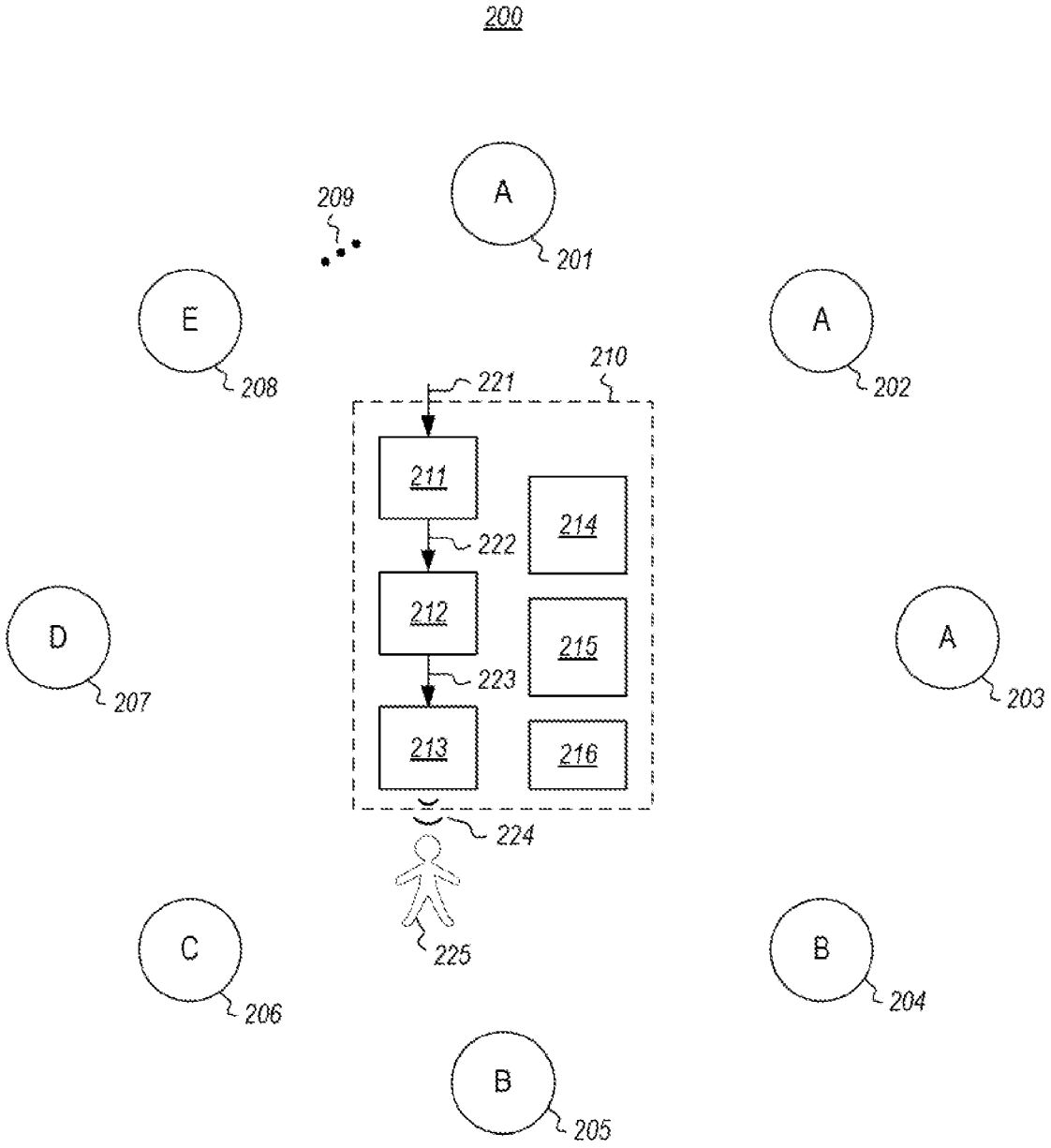
FIG. 2 abstractly illustrates an environment in which a physical system is located and has access to audio broadcast sources.

FIG. 2 abstractly illustrates an environment 200 in which a physical system 210 is located and has access to audio broadcast sources. The physical system 210 includes a receiver 211 that receives broadcast audio content stream transmissions (as represented by arrow 221 and 222) from audio broadcast sources, a tuner 212 that tunes to one of the audio content streams (as represented by arrow 223) from an audio broadcast source, and an audio renderer 213 that renders (as represented by emission 224) the audio content stream into sound for a listener 225.

The physical system 210 also includes a geographical data source 214 and a logic component 215 that function to facilitate embodiments described further below with respect to FIG. 3 through 5 below. The physical system 210 may optionally also include a geographic location determination unit 216 (such as a global positioning system or "GPS") to help determine the current geographic location of the receiver 211.

There is no physical restriction on the form of the physical system 210. For instance, the physical system 210 might be a portable radio, in which case perhaps the receiver 211, the tuner 212 and the audio renderer 213 are integrated within the same device. The physical system 210 might alternatively be a vehicle in which case perhaps the receiver 211, the tuner 212, the audio renderer 213 and/or the geographic location determination unit 216 might be somewhat more distributed throughout different parts of the vehicle. Alternatively, the physical system 210 might be quite distributed, with the receiver 211 and the audio renderer 213 perhaps even being remotely located.

Regardless of whether the receiver 211, tuner 212 and the audio renderer 213 are integrated into the same device or vehicle, or are more distributed, the data source 214 may be local to the audio renderer 213, remote from the audio renderer 213, or some combination. For instance, all or part (or none) of the data source 214 might be remotely located from the receiver 211. For instance, the data source 214 might be completely or partially located in a storage service within a cloud computing system. Alternatively or in addition, some or all of the data source might be a peer in a peer-to-peer network. Likewise, the logic unit 215 may be local to the audio renderer 213, remote from the audio renderer 213 or some combination. For instance, all or part (or none) of the logic unit 215 might be located in a compute service within a cloud computing system.

In this particular example, the environment 200 includes eight broadcast sources 201 through 208. A broadcast source includes any source of an analog and/or digital audio content stream. Examples of types of audio broadcasting sources include Amplitude Modulation (AM) stations, Frequency Modulation (FM) stations, digital radio stations, satellite radio channels, and an Internet radio channels. The ellipses 209 represents that there might be any number of audio broadcast sources available to the receiver 211 of the physical system 210. For instance, in populated areas, there are typically dozens of AM radio stations and FM radio stations available to a radio receiver.

The eight broadcast sources 201 through 208 represent sources that the tuner 212 is configured to tune to. For instance, in cases of the broadcast sources 201 through 208 being free of charge, the tuner might have no restriction on tuning to any broadcast source that the receiver 211 is capable of receiving at sufficient signal strengths. On the other hand, there may be reason for imposing a policy on which broadcast sources are going to be made available to the tuner 212 given the current geographical region. For instance, subscription-based broadcast sources might be restricted in certain regions, even if it is physically possible for the receiver 211 to receive the broadcast at sufficient strength. In other cases, some broadcast sources may have no geographical restriction imposed at all, and may be received everywhere in the globe (such as Internet radio).

FIG. 2 is merely an abstract representation of the environment 200. The location of the broadcast sources 201 through 209 is not literal. For instance, it is common for multiple AM stations to be broadcast from a single transmission tower, and yet each station would still be considered a separate audio broadcast channel within the environment 200. Likewise, a particular AM station might also be broadcast by an Internet radio source, and thus these two sources would each be considered a separate audio broadcast channel. The point is that for any given geographic location, a signal receiver of a physical unit will have access to a number of audio broadcasting sources, each broadcasting a particular audio content stream. One might be broadcasting music, another might be broadcasting audio with commentary of a live sporting event, another might be a news program, and so forth.

In the example of FIG. 2, some of the audio broadcasting sources broadcast the same audio content stream. The identity of the audio content stream is symbolized by a letter appearing within each of the broadcasting sources 201 through 208, where if two broadcasting sources are broadcasting the same audio content stream, they contain the same letter. For instance, three audio broadcast sources 201, 202 and 203 are each broadcasting the same audio content stream A (as an example, perhaps audio feed from a live sporting event). Two audio broadcast sources 204 and 205 are broadcasting the same audio content stream B (as an example, a same news channel). The remaining three audio broadcast sources 206, 207 and 208 are each broadcasting different audio content streams C, D and E, respectively. This example environment 200 will be referred to frequently in subsequent description. However, it is understood that the environment is an example only, and will change with movement of the receiver 211 or with changes in environmental conditions (such as weather).

Figure 3:
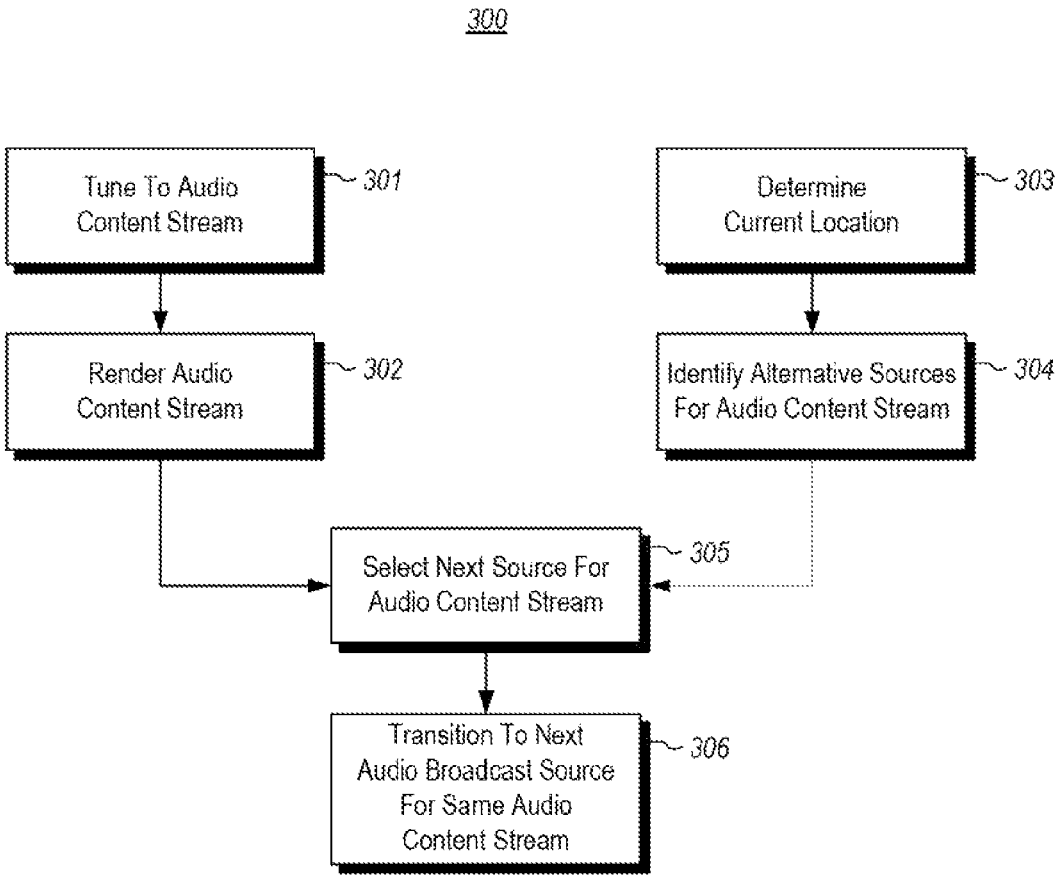
FIG. 3 illustrates a flowchart of a method for automatically switching rendered audio from one broadcasting source to another broadcasting source.
Figure 4:
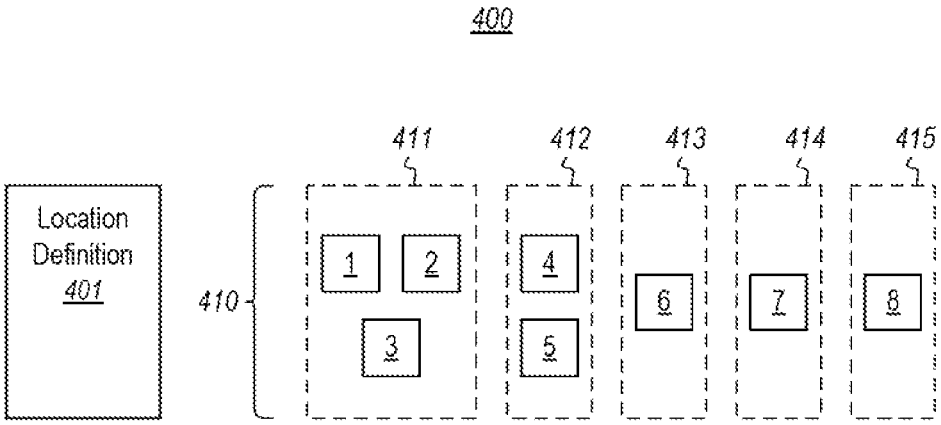
FIG. 4 illustrates an example geographic entry, which includes a geographic definition that defines the geographic region in which the entry applies, and which includes other parameters associated with receiving in that geographic region.

FIG. 3 illustrates a flowchart of a method 300 for automatically switching rendered audio from one broadcasting source to another broadcasting source. The method 300 will be explained with reference to the example environment 200 of FIG. 2, although the method 300 may be performed in any environment. In fact, the principles described herein are particularly useful when the audio broadcast receiver 211 moves from one environment to another. For instance, as the receiver 211 moves, one or more of the potential audio broadcasting sources 201 through 209 may be dropped as no longer available options, and one or more other broadcasting sources may be added to the available options for audio broadcasting sources. As the receiver 211 moves, this adding and dropping of available options may change as the geographical location changes.

The illustrated method 300 includes tuning the audio content stream from a particular broadcasting source (act 301). For instance, in the context of FIG. 2, the receiver 211 receives (as represented by arrows 221 and 222) the audio broadcast transmissions from the audio broadcast sources 201 through 209. However, suppose that audio content stream A is an audio feed from a live sporting event that the listener 225 intends to listen to. The listener 225 may thus cause the tuner 212 to tune to audio content stream A by, for instance, tuning to the audio transmission from the audio broadcasting source 201. This tuning might be between different channels of the same type (e.g., from one AM station to another AM station), or may be between channels of different types (e.g., from one AM station to an Internet radio channel, from an AM station to an FM channel, from an Internet radio channel to an AM or FM station, and so forth).

In response, the audio renderer (e.g., a speaker) begins rendering the audio content stream (act 302). For instance, in FIG. 2, the audio renderer 213 renders (as represented by arrow 224) the audio to the listener 225, allowing the listener 225 to enjoy the audio content stream A, and root for his or her home sports team.

The physical system 210 also identifies a current geographic location (act 303) of the receiver 211. If the physical system 210 is an integrated system such as a radio or a vehicle, the current geographic location of the receiver 211 is the same as that of the physical system 220 as a whole. As previously mentioned, the physical system 210 includes a geographic location determination unit 216 to help determine the current geographic location of the receiver 211. An example is a Global Positioning System (GPS), but other mechanisms may be used to determine current location such as radio tower triangulation.

The physical system 210 (e.g., perhaps the logic unit 214) also identifies one or more alternative broadcasting sources for the audio content stream based on the current geographical location (act 304). For instance, in the environment 200, there happen to be two other alternative audio broadcasting sources 202 and 203, which are also transmitting the same audio content stream A that the listener 225 is currently listening to.

The acts 303 and 304 are illustrated in parallel with acts 301 and 302. This is to emphasize that the available alternative audio broadcasting sources may be identified in advance, and/or concurrently with the listener 225 actually listening to the audio content stream from one of the alternatives.

While still rendering the original audio content stream (begun in act 302), the physical system selects (act 305) a next broadcasting source that is to be switched to as a source for the audio content stream. Referring to FIG. 2, the physical system 210 (or more specifically the logic unit 215) might select the alternative broadcasting source 202, which is also broadcasting audio content stream A, to be switched to as a source for the audio content stream A for the listener 225.

As part of this process, the logic unit may have accessed the data source 214. For instance, upon determining what the current geographic location is (act 303), the logic unit 215 may access the data source 214, which may have an entry for each of multiple geographic locations. FIG. 4 illustrates an example geographic entry 400, which includes a geographic definition 401, which defines the geographic region in which the entry applies. The entry also includes a multiple sets 410 of audio broadcasting sources, each set including those broadcasting sources that are potential candidates for transmitting the same audio content stream, For instance, the multiple sets 410 includes set 411 that includes an identity 1 through 3 (corresponding to respective broadcasting sources 201 through 203), set 412 that includes identity 4 and 5 (corresponding to respective broadcasting sources 204 and 205), set 413 that includes identity 6 (corresponding to broadcasting source 206), set 414 that includes identity 7 (corresponding to broadcasting source 207), and set 415 that includes identity 8 (corresponding to broadcasting source 408).

Thus, suppose that location of receiver 211 of FIG. 2 falls within the geographical location definition 401 of entry 400. The logic unit 214 could evaluate the entry to determine that the current station corresponds to identity 1 within the set 411. Thus, the logic unit could use set 411 to determine that the broadcast sources 202 and 203 (corresponding to identity 2 and 3) are also likely available for the same broadcasting source.

The logic unit 214 might take more affirmative action to actually verify that while act 302 is being performed (audio content stream A is being rendered by tuning to audio broadcast source 201), that the alternative broadcasting sources 202 and 203 are indeed also broadcasting audio content stream A. For instance, the logic unit 214 might very quickly tune to the other audio broadcast source 202 and 203, and capture a small audio sample from the alternative source, perform analysis of the small audio sample, and determine whether the small audio sample matches any portion of what is being tuned to in act 301. The time that the tuner temporarily switches to the alternative audio broadcasting sources 202 or 203 may be kept small enough not to be noticed by a human listener. If the first performance of this brief tuning switch is not enough to conclusively determine whether the audio content streams are the same (e.g., perhaps there happened to be a small period of silence in the alternative broadcasting source 202 and 203 in the small window of time), the process may be repeated, until a sample or samples are captured for a conclusive determination to be made. If a second tuner was available, the logic unit 214 might simply use that second turner to tune to the other audio broadcast source 202 and 203, while allowing the first tuner to continue being tuned to the original audio broadcast source 201.

Figure 5:
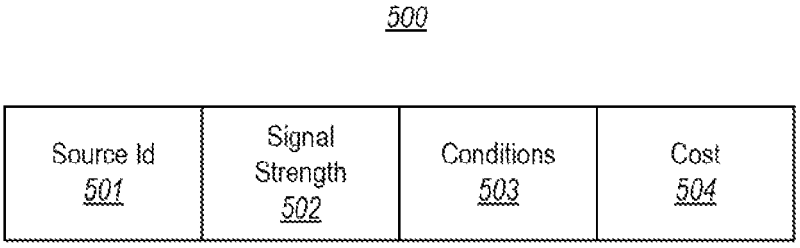
FIG. 5 illustrates an example broadcast source entry of FIG. 4 in further detail.

FIG. 5 illustrates an example broadcast source entry 500 in further detail. For instance, there may be an entry 500 for each of the broadcasting sources 201 through 208. The entry 500 includes a source identifier 501 corresponding to the audio broadcasting sources. For instance, in FIG. 4, there is a source identifier 1 through 8 corresponding to audio broadcast sources 201 through 208. The entry 500 might also include a signal strength representation 502 that indicates what the historical signal strength is for the particular region identified by the geographical location definition 401. The entry might also include conditions 403 (such as time ranges) in which the audio broadcast source is considered to potentially be broadcasting the same audio content stream as the other audio broadcast sources within the corresponding set 410. The entry 500 might also include a cost field 504 specifying costs associated with using the audio broadcast source. The entry 500 might also include the song name, the artist name, or any of identifying text which may help to match up the broadcast sources.

Thus, once the corresponding set of the geographic entry 400 is accessed, the entry 500 for each of the alternative audio broadcast sources may be evaluated to determine (based on typical previously-measured signal strength in that region, based on whether or not conditions are right for the alternative to be a likely alternative source for the same audio content stream, what the cost of use of the audio content stream is, or based on any other parameters included within the entry) which of the alternative audio broadcast sources should be the next audio broadcast source for the same audio content stream (act 305).

The logic unit 314 might also consider a direction of movement in deciding an appropriate next audio broadcast source to switch to. For instance, suppose that the user is moving towards another geographic location defined within another entry 500. That entry 500 will have different sets of common potential sources of audio content streams. The logic unit may evaluate alternatives for the same audio content stream (e.g., stream A) in the next geographic region as well. The logic unit 214 may thus balance what the best next alternative audio broadcast source for the same audio content stream is in the current geographic location against what the best next alternative audio broadcast source for the same audio content stream is in the next geographic location.

In predicting where the receiver is moving to, the receiver might use simply the direction of movement, statistical prediction based on prior movement, and/or might use a current calculated path on a navigation system. For instance, if the user is generally moving north-easterly, the logic unit might scan the entry 500 for the next region to the northeast. If the user has been travelling on a highway for a long period of time, the logic unit might scan the entry 500 for the next region along that highway. If the user is being guided by a navigation system along a calculated route, the logic unit might scan the entry 500 for the next region along that route.

The granularity for how a geographical region is defined might correspond generally to the gradient of change with distance of signal strength. For instance, in canyons where signals are often blocked by natural terrain, or in urban areas where signals are often blocked by man-made structures, the geographical definitions may define much smaller areas since small movements may make a greater difference on the available options for alternative audio broadcast sources. In other areas, a geographical region may be defined in terms of hundreds of square miles or kilometers.

Once the next audio broadcast source is selected (act 305), the physical system transitions (act 306) the rendering so that the audio content stream is received from the next audio broadcast source. For instance, in the context of FIG. 2, suppose the audio broadcast source 202 was selected as the next audio broadcast source for the same audio content stream A, the tuner 212 would ultimately change to being tuned to the audio broadcast source 202.

There are numerous ways to perform this transition. The most straightforward way is to simply switch the tuner 212 to the next audio broadcast source discretely after determining that the switch should be made. This can, however, result in the user noticing the change. There are more nuanced ways of making this transition, however, that may result in a less jarring experience for the user.

For instance, suppose that audio content stream A is being delivered from audio broadcast source 201 three seconds ahead of the audio content stream A as delivered from the audio broadcast source 202. A straight switch would be perceived by the listener as re-listening to the same three seconds of feed twice. If the current audio broadcast source 201 is being listened to in delayed mode by more than three seconds, then the switch may happen immediately except that the next broadcast source 202 is begun with three seconds less delay. Another way to handle this if there is no delay in the current audio broadcast source 201 is to make the switch when 3 seconds of silence or a commercial is observed in the audio broadcast source 202. The listener would simply miss that three seconds of silence, or commercial.

Alternatively, suppose that audio content stream A is being delivered from audio broadcast source 201 three seconds behind the audio content stream A as delivered from the audio broadcast source 202. A straight switch would be perceived by the listener as skipping three seconds into the future, with three seconds of the audio content stream being missed. The logic unit 214 might account for this by buffering three seconds worth of the audio broadcast stream A from audio broadcast source 202 while still allowing the listener to listen to the audio broadcast stream A from the audio broadcast source 201, and then switch to the audio broadcast source 202 in a manner as to be three seconds delayed from what otherwise would be heard from the audio broadcast source 202.

When transitioning (act 306) to the next audio broadcast source may also be performed by smoothing any audio characteristics between the current and next audio broadcasting sources. For instance, if it appears that the volume of the next audio broadcasting source is higher than the current audio broadcasting source, the logic unit 214 may automatically cause the audio renderer 213 to adjust down the volume an equivalent amount at the same time as the tuner 212 tunes to the next audio broadcast source, so that the listener does not observe a difference in volume when the switch occurs. As another example, if it appears that the audio frequency of the next audio broadcasting source is different (perhaps has more bass) than the current audio broadcasting source, the logic unit 214 may automatically cause the audio renderer 213 to adjust the audio frequency balance at the same time as the tuner 212 tunes to the next audio broadcast source, so that there is no overall change in audio frequency balance detected by the listener.

Accordingly, a mechanism for automated switching of audio broadcast sources is described in which the user is permitted to listen to the same audio content stream.

There might be a large group of physical systems similar to the one described with respect to physical system 210 of FIG. 2. Each physical system is at a different location at different times. Thus, numerous numbers of such physical systems may be distributed throughout the globe. This allows for a tremendous potential to gather information regarding the alternative audio broadcast sources available throughout different regions of the world. For instance, if one physical system measures system strength, and confirms that as of a particular time, two audio broadcast sources are transmitting the same audio content stream at a particular time, and each with a particular signal strength, that information may be shared for other similar physical systems to take advantage of when they are within that same geographical region. Numerous geographic location entries 400 for different geographical locations may be populated using such information.

Figure 6:
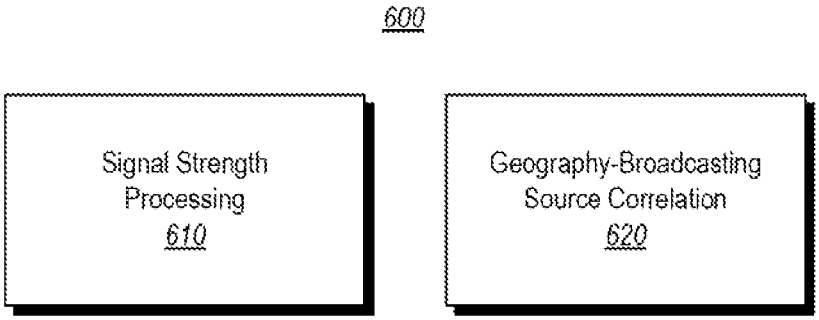
FIG. 6 illustrates a system that comprises a signal strength processing system and a geography-broadcasting source correlation system.

FIG. 6 illustrates a system 600 that comprises a signal strength processing system 610 and a geography-broadcasting source correlation system 620. The signal strength processing system 610 is configured to process data received from different physical systems (such as the physical system 210 of FIG. 2). The received data may include a geographical location of the receiver of the physical system, an identity of a broadcasting source for an audio content stream being received by the physical unit, and an estimate of signal strength of the audio content stream as received by the receiver. The geography-broadcasting source correlation system 620 is configured to correlate a set of one or more potential broadcasting sources with a corresponding geographic location for each of multiple geographical locations. Thus, together, the systems 610 and 620 may gather information from numerous physical systems distributed throughout the globe, and populate entries 400 associated with each of numerous geographic locations. The systems 610 and 620 may each be implemented, for example, in a cloud computing environment.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed:

1. A computer system, comprising:

one or more processors; and one or more computer-readable hardware storage devices having stored thereon computer-executable instructions that are executable by the one or more processors to cause the computer system to automatically switch rendered audio from one broadcasting source to another broadcasting source, and further to cause the computer system to perform at least the following:

receive, by a receiver of the computer system, an audio content stream from a first broadcasting source;

render the audio content stream received from the first broadcasting source;

identify a current geographical location of the receiver;

identify one or more alternative broadcasting sources determined to be broadcasting an audio content stream that is substantially similar to the audio broadcasting stream received from the first broadcasting source, wherein the identification of the one or more alternative broadcasting sources is at least partially based on the current geographical location of the receiver;

verify that the audio content stream received from the one or more alternative broadcasting sources is substantially similar to the audio content stream received from the first broadcasting source, wherein the verification includes comparing an audio sample taken from the first broadcasting source with an audio sample taken from the one or more alternative broadcasting sources;

while still rendering the audio content stream received from the first broadcasting source, select a second broadcasting source that is to be switched to as a source for the audio content stream, the second broadcasting source being selected from among the indentified one or more alternative broadcasting sources; and transition from receiving the audio content stream from the first broadcasting source to receiving the audio content stream from the second broadcasting source.

2. The computer system in accordance with claim 1, the first broadcasting source being a station of a first type selected from a group consisting of an Amplitude Modulation (AM) station, a Frequency Modulation (FM) station, a digital radio station, a satellite radio station, and an Internet radio station.

3. The computer system in accordance with claim 2, the second broadcasting source being a station of a second type selected from a group consisting of an Amplitude Modulation (AM) station, a Frequency Modulation (FM) station, a digital radio station, a satellite radio station, and an Internet radio station.

4. The computer system in accordance with claim 3, wherein the first type of the station of the first broadcasting source is of a different type than the second type of the station of the second broadcasting source.

5. The computer system in accordance with claim 3, wherein the first type of the station of the first broadcasting source is of a same type as the second type of the station of the second broadcasting source.

6. The computer system in accordance with claim 1, wherein the identification of the one or more alternative broadcasting sources comprises:

accessing a data source that includes one or more potential broadcasting sources for each of a plurality of geographical locations.

7. The computer system in accordance with claim 6, wherein a determination of whether to include the one or more potential broadcasting sources in the data source is based on a measured signal quality for each of the one or more potential broadcasting sources.

8. The computer system in accordance with claim 6, wherein a determination of whether to include the one or more potential broadcasting sources in the data source is based on a cost field for each of the one or more potential broadcasting sources.

9. The computer system in accordance with claim 6, wherein the data source also includes a previously-estimated signal strength for at least one of the one or more potential broadcasting sources.

10. The computer system in accordance with claim 6, wherein the data source is at least partially remotely located such that the identification of the one or more alternative broadcasting sources is performed by remotely communicating with at least a portion of the data source.

11. The computer system in accordance with claim 1, wherein the selection of the second broadcasting source is performed using information obtained from a remote source.

12. The computer system in accordance with claim 1, wherein the selection of the second broadcasting source is also at least partially based on a function of an estimated signal strength for the second broadcasting source.

13. The computer system in accordance with claim 1, wherein the selection of the second broadcasting source is also at least partially based on a function of a direction of movement of the receiver.

14. The computer system in accordance with claim 1, wherein the selection of the second broadcasting source is also at least partially based on a function of a cost of using the second broadcasting source.

15. The computer system in accordance with claim 1, wherein transitioning from receiving the audio content stream from the first broadcasting source to receiving the audio content stream from the second broadcasting source comprises:

adjusting for a difference in time delivery of the audio content stream between the first broadcasting source and the second broadcasting source.

16. The computer system in accordance with claim 1, wherein transitioning from receiving the audio content stream from the first broadcasting source to receiving the audio content stream from second broadcasting source comprises:

adjusting for a difference in audio characteristics of the audio content stream between the first broadcasting source and the second broadcasting source.

17. The computer system in accordance with claim 16, wherein transitioning from receiving the audio content stream from the first broadcasting source to receiving the audio content stream from the second broadcasting source comprises:

adjusting for a difference in volume of the audio content stream between the first broadcasting source and the second broadcasting source.

18. The computer system in accordance with claim 16, wherein transitioning from receiving the audio content stream from the first broadcasting source to receiving the audio content stream from the second broadcasting source comprises:

adjusting for a difference in audio frequency balance of the audio content stream between the first broadcasting source and the second broadcasting source.

19. A method, implemented at a computer system that includes one or more processors, for automatically switching rendered audio from one broadcasting source to another broadcasting source, the method comprising:

receive, by a receiver of the computer system, an audio content stream from a first broadcasting source;

render the audio content stream received from the first broadcasting source;

identify a current geographical location of the receiver;

identify one or more alternative broadcasting sources determined to be broadcasting an audio content stream that is substantially similar to the audio broadcasting stream received from the first broadcasting source, wherein the identification of the one or more alternative broadcasting sources is at least partially based on the current geographical location of the receiver;

verify that an audio content stream received from the one or more alternative broadcasting sources is substantially similar to the audio content stream received from the first broadcasting source, wherein the verification includes comparing an audio sample taken from the first broadcasting source with an audio sample taken from the one or more alternative broadcasting sources;

while still rendering the audio content stream received from the first broadcasting source, select a second broadcasting source that is to be switched to as a source for the audio content stream, the second broadcasting source being selected from among the identified one or more alternative broadcasting sources; and transition from receiving the audio content stream from the first broadcasting source to receiving the audio content stream from the second broadcasting source.

20. One or more hardware storage devices having thereon computer-executable instructions that are executable by one or more processors of a computing system to cause the computing system to automatically switch rendered audio from one broadcasting source to another broadcasting source by at least causing the computing system to do the following:

receive, by a receiver of the computing system, an audio content stream from a first broadcasting source;

render the audio content stream received from the first broadcasting source;

identify a current geographical location of the receiver;

identify one or more alternative broadcasting sources determined to be broadcasting an audio content stream that is substantially similar to the audio broadcasting stream received from the first broadcasting source, wherein the identification of the one or more alternative broadcasting sources is at least partially based on the current geographical location of the receiver;

verify that an audio content stream received from the one or more alternative broadcasting sources is substantially similar to the audio content stream received from the first broadcasting source, wherein the verification includes comparing an audio sample taken from the first broadcasting source with an audio sample taken from the one or more alternative broadcasting sources;

while still rendering the audio content stream received from the first broadcasting source, select a second broadcasting source that is to be switched to as a source for the audio content stream, the second broadcasting source being selected from among the identified one or more alternative broadcasting sources; and transition from receiving the audio content stream from the first broadcasting source to receiving the audio content stream from the second broadcasting source.

* * * * *